US005769167A

United States Patent [19]

Braddick

[11] Patent Number: 5,769,167

[45] Date of Patent: Jun. 23, 1998

[54] THRU TUBING WHIPSTOCK AND METHOD

[75] Inventor: Britt O. Braddick, Houston, Tex.

[73] Assignee: TIW Corporation, Houston, Tex.

[21] Appl. No.: 682,422

[22] Filed: Jul. 17, 1996

[51] Int. Cl.[6] ..... E21B 23/00

[52] U.S. Cl. ..... 166/382; 166/117.6

[58] Field of Search ..... 166/117.5, 117.6, 166/206, 381, 382

[56] References Cited

U.S. PATENT DOCUMENTS

| | | | |
|---|---|---|---|
| 4,153,109 | 5/1979 | Szescila | 166/117.6 X |
| 4,509,060 | 4/1985 | Carter | 166/117.6 X |
| 5,425,419 | 6/1995 | Sieber | 166/117.6 X |
| 5,551,509 | 9/1996 | Braddick . | |

FOREIGN PATENT DOCUMENTS 2299105 9/1996 United Kingdom .

OTHER PUBLICATIONS

U.S. application No. 08/409,276 filed Mar. 23, 1995.

PCT Publication No. WO 95/07404, published 16 Mar. 1995.

Copy of Great Britain Search Report for Appln. No. GB 9714517.1 dated Oct. 7, 1997.

*Primary Examiner*—Roger J. Schoeppel
*Attorney, Agent, or Firm*—Browning Bushman

[57] ABSTRACT

A thru tubing whipstock assembly 10 may be set within a casing string CS after passing through the lower end of a smaller diameter tubing string TS. Once set within the casing string CS, the whipstock face 18 on whipstock body 12 may divert a rotatable bit B for cutting a window in the casing string CS. The whipstock assembly 10 includes an anchor A below the whipstock body 12 for securing the set whipstock assembly within the casing string. A hinge assembly 14 below the whipstock body 12 may be pivoted from a run-in position for passing through the tubing string to a set position for positioning the whipstock face 18 for engagement with the bit B. A wedge assembly 38 is provided at the upper end of whipstock body 12 and is also movable from a run-in position to a set position. The wedge assembly includes an outer wedge member 102 for engaging an interior wall of the casing string at a position circumferentially opposite the location where the window is to be cut, and an inner wedge member 104 slidably moveable with respect to both the outer wedge member 102 and the whipstock body 12. An elongate rod 52 is positioned within a bore 54 extending through the outer wedge member, the inner wedge member, and an upper portion of the whipstock body 12 when in the run-in position. The rod 52 retains the wedge assembly in the run-in position, and is removed to allow the outer wedge member 102 and inner wedge member 104 to move to the set position. A rod extension 92 extends through a passageway 94 in the whipstock body 12 so that a lower end of the rod extension 92 fits within a socket 160 within a hinge arm 166 to retain the hinge assembly in the run-in position. Once the rod 52 is moved upward, the biasing force of a spring 150 moves the rod extension 92 out of the socket 160, thereby allowing the hinge assembly to pivot to its set position. The whipstock assembly is also retrievable through the tubing string.

43 Claims, 5 Drawing Sheets

THRU TUBING WHIPSTOCK AND METHOD

FIELD OF THE INVENTION

The present invention relates generally to a thru tubing whipstock of the type suitable for cutting a casing window or for drilling a lateral from the casing string into a hydrocarbon bearing formation. More particularly, this invention relates to a thru tubing whipstock and method of setting a whipstock suspended from coiled tubing workstring in a casing string after passing through a tubing string.

BACKGROUND OF THE INVENTION

A whipstock is a downhole diversion tool inserted in the wellbore and used for deflecting a drill bit, mill or other tool in a direction that is angularly offset with respect to the orientation of an original wellbore. The deflected mill or bit may thus establish a new or additional drilling path. In many instances, a whipstock set in a casing string on an anchor provides an angled whipstock surface or whipstock face at the desired depth in the wellbore to conduct side track or lateral directional drilling operations through the casing string. The face of the whipstock is thus oriented to position the casing window at a desired radial azimuth relative to the axis of the casing in accordance with the new drilling course.

It is frequently desirable to cut or mill a window in a casing string that includes therein a smaller diameter tubing string that terminates at a position above the desired position of the casing window. Since the removal of the tubing string requires considerable rig time and expense, thru tubing whipstock assemblies have been developed for first passing through the tubing string then setting in the casing string at the desired depth for milling or cutting the window in the casing string. Once the window has been properly cut in the casing string, a side track or lateral drilling operation may proceed in the desired azimuthal direction relative to the casing string, using the whipstock face as the diversion tool for the drilling bit. An exemplary thru tubing whipstock according to the present invention is disclosed in pending U.S. Ser. No. 08/409,276 filed Mar. 23, 1995, now U.S. Pat. No. 5,595,247.

In many applications, it is desirable to suspend a drill motor and a bit rotatable by the drill motor from coiled tubing workstring for engaging the set whipstock in the casing string. Fluid is pumped through the coiled tubing workstring to drive the drill motor, so that the rotating bit engages the whipstock face and begins cutting a window in the casing string with an operation involving a single run-in trip of coiled tubing workstring. Although coiled tubing workstring operations are considerably less expensive than operations involving a drilling and workover rig utilizing a conventional threaded tubular workstring and thereby save the operator considerable time and expense, conventional tubular workstrings may nevertheless be employed.

When setting a thru tubing whipstock suspended from coiled tubing workstring within a casing string, setting slips on the anchor may be expanded to engage an inner wall of the casing string. The whipstock face may thereafter be oriented to obtain a desired azimuth for cutting the casing window once it has been set in non-rotational engagement with the set anchor. To properly position the whipstock face within the casing string, a downward force may be applied to the whipstock body to shear a pin within a hinge mechanism at the lower end of the whipstock body, thereby pivoting the lower whipstock face against the side of the casing string where the window is to be cut. This latter setting operation for properly positioning the whipstock face within the casing string cannot be reliably performed in many applications wherein the whipstock is suspended on coiled tubing workstring, however, since the necessary downward setting force cannot be transmitted through the coiled tubing workstring to shear the pin and allow the hinge mechanism at the lower end of the whipstock face to be moved to its set position. Also, since coiled tubing workstring stretches axially and since there is very little axial movement of the whipstock body during this hinge mechanism setting operation, the operator at the surface cannot reliably determine if the hinge mechanism has been properly activated.

In order to initiate the window cutting operation, a starter mill rotated by the drill motor may engage a tapered pilot lug at the upper end of the whipstock body. The pilot lug directs the starter mill into engagement with the side wall of the casing, thereby forcing the rotating mill to effectively penetrate the casing so that the mill cuts the window in the casing rather than milling the whipstock body. In order to facilitate cutting the window, the starter mill may include a lower nose piece which is independently rotatable relative to the mill blades or cutters. The nose piece thus engages the lug to divert the mill cutters into cutting engagement with the casing while the non-rotating nose piece engages the lug. The outer diameter of the nose piece at its upper end is greater than the radial spacing between the pilot lug and the opposite side of the casing wall to be milled. As the mill is lowered with respect to the lug, the nose piece becomes wedged between the lug and the casing, thereby preventing further downward movement of the mill. Dimensions between the pilot nose and the casing are thus controlled so that this wedging operation will occur after the starter mill has milled away a sufficient amount of casing to properly commence the window cutting operation, but before the starter mill has milled the whipstock face or body. This arrangement thus prevents damage to the whipstock body. Moreover, since the torque required to rotate the wedged mill then becomes negligible, the operator is assured that the casing window milling operation has been completed to a desired initial extent by monitoring the drop in fluid pressure required to drive the drill motor once the nose piece becomes wedged between the lug and the casing. Upon noticing the marked reduction in torque required to operate the drill motor, the drilling operator may then retrieve the starter mill. After the starter mill has been replaced by a window mill, the window mill may cut off the remaining portion of the lug while continuing to cut a window in the casing with the mill being diverted by the whipstock face. A window mill or bit may thus finish cutting the window in the casing or may drill a lateral in the formation exterior of the casing. After the starting mill has commenced properly cutting a window in the casing, the window mill or bit reliably continues the window cutting operation since the radial force tending to push the rotating mill or bit radially against the whipstock face is substantially reduced.

Additional problems are encountered utilizing a thru tubing whipstock with a lug as described above in combination with a starter mill with an independently rotatable nose piece. The thru tubing whipstock body inherently must have a diameter less than the internal diameter of the tubing string through which the whipstock must pass. In many applications, the whipstock is set in a casing string with an internal diameter significantly larger than the maximum diameter of the whipstock body. In some applications, the whipstock effectively cannot benefit from utilizing a lug as described above in conjunction with a starter mill with an independently rotatable nose piece since the radial thickness of the required nose piece may be greater than the internal diameter of the tubing string through which the whipstock must pass. Also, since the lug must be properly sized for engagement with a starter mill with an independently rotatable nose piece, a window mill which replaces the starter mill may not be able to pass through the tubing string and have a diameter sufficient to cut off the lug while simultaneously continuing to cut the window in the casing string. Accordingly, the window cutting operation cannot properly continue in the manner which takes advantage of the benefits of the lug and the independently rotatable nose piece, as discussed above. Further details with respect to a whipstock assembly with a lug for operation in conjunction with a starter mill with an independently rotatable nose piece are disclosed in U.S. Ser. No. 08/409,879 filed Mar. 24, 1995, now U.S. Pat. No. 5,551,509.

Consequently, there remains a need for an improved whipstock and for techniques for setting and properly positioning a whipstock face within a casing string that offers the operator more flexibility to reduce drilling time and costs by allowing the whipstock to be positioned in a casing string below a tubing string which remains fixed within the wellbore at a position above the position where the window is to be cut. According to the present invention, a whipstock may be reliably passed through a tubing string then set in a much larger diameter casing string, with the whipstock being positioned at the desired depth for cutting the window in the casing string. Those skilled in the art have long sought or appreciate the advantages of the present invention which provides solutions to these and other problems.

SUMMARY OF THE INVENTION

A whipstock assembly according to exemplary embodiment of the invention includes a whipstock body, a bow spring centralizer, and an anchor for securing the assembly within a casing string. The whipstock assembly may be positioned downhole suspended from a coupled or coiled tubing workstring, and passes through a small diameter tubing string before being set in a larger diameter casing string at a position below the lowermost portion of the tubing string. The whipstock assembly may be used as a diverter for diverting a rotating starter mill to begin cutting a window in the casing string, and thereafter for diverting a mill or bit to finish cutting the window and to drill a lateral into an earth formation extending outward from the casing string. A starter mill may be rotated by a downhole mud motor. Both the motor and starter mill may also pass through the tubing string and may be suspended within the casing string or workstring. The workstring transmits pressurized fluid to activate the mud motor, and is lowered so that the mill engages the stationary whipstock body to begin cutting the casing window. After cutting the window, the coiled tubing workstring is pulled back to the surface, thereby retrieving the downhole motor and rotatable mill. The whipstock assembly may then also be retrieved to the surface through the tubing string.

The whipstock body is an elongate member with a concave face matching the radius of the window mill and which is angled with respect to the axis of the casing string when the whipstock assembly is set to divert the starter mill. The maximum diameter of the whipstock body must be less than the internal diameter of the tubing string in order to pass through the tubing string. A hinge assembly is provided at the lower end of the whipstock body to pivot the lower end of the whipstock face toward engagement with the casing string at a circumferential position aligned with the window to be cut. A lug is provided at the upper end of the whipstock body to initially divert the starter mill. A nose piece independently rotatable with respect to the starter mill cutters is wedged between the nose piece and the casing string once the starter mill finishes its initial cut of the window. Once wedged, the starter mill cannot be thereafter lowered with respect to the whipstock body, thereby significantly reducing the pressure to the mud motor and alerting the drilling operator to the successful completion of the initial window cutting operation. A window mill may then be used to mill off the remaining portion of the lug and finish cutting the window while being diverted by the whipstock face.

In order to properly position the whipstock lug within the casing string for engagement with the starter mill, one or more wedge members are provided at the upper end of the whipstock body. Each wedge member is moveable radially outward with respect to the whipstock body from a run-in position to a set position. An upper or outer wedge member may be moved for engagement with the casing string at a circumferential position radially opposite the position where the window is to be cut, while a lower or inner wedge member moves radially outward to be sandwiched between the outer wedge member and the whipstock body. The radial spacing of the outer and inner wedge members thus desirably positions the whipstock lug at the upper end of the whipstock body within the casing string for engagement with the starter mill. A single wedge or multiple wedges may be employed as required depending upon the whipstock outside diameter with the size of casing in which it is set.

To prevent the inadvertent movement of the wedges with respect to the whipstock body, an elongate rod is positioned within a bore extending through the upper wedge, then through the lower wedge, and then into the whipstock body. The rod must thus be removed in order for each wedge to move radially outward. A lower face of the upper wedge and an upper face of the lower wedge include a dovetail interconnection for allowing sliding movement once the rod is removed. A lower face of the lower wedge and an upper face of the whipstock body include a similar dovetail connection. Biased locking members are provided for locking the outer wedge with respect to the inner wedge, and for locking the inner wedge with respect to the whipstock body, once each of the wedges is properly positioned within the casing string.

A hinge assembly at the lower end of the whipstock body includes an arm pivotably connected to the whipstock body by a first pin, and pivotably connected to a sub secured to the anchor by a second pin. A rod extension within a passageway in the whipstock body extends from the wedge assembly to the hinge assembly. When the whipstock assembly is run in the well, a lower end of the rod extension fits within a socket within the arm to prevent rotation of the arm about the first pin with respect to the whipstock body. The rod thus retains both the hinge assembly and the wedge assembly in their run-in positions. When the rod is pulled upward with respect to the whipstock body, the lower end of the rod extension moves out of the socket, allowing the arm to pivot with respect to the whipstock body and with respect to the sub fixed to the anchor. When the rod is removed from the bore in the wedge assembly, the upper and lower wedges are free to move to their radially outer and radially inner positions, respectively.

It is an object of the invention to provide an improved whipstock assembly for passing through a tubing string and then setting within a casing string. The whipstock assembly of the present invention may be set within a casing string which has a diameter significantly larger than the diameter of the tubing string, yet still properly position the whipstock face and whipstock lug for reliable engagement with a rotating starter mill.

It is also an object of this invention to provide an improved technique for properly positioning a whipstock assembly within a well. The whipstock setting operation may be reliably performed by exerting only tensile rather than compression forces on the coiled tubing workstring used to position the whipstock assembly within the well. The coiled tubing workstring may also be released from the whipstock assembly by using only tensile forces exerted on the coiled tubing workstring. By requiring only tensile forces to set and release from the whipstock assembly, coiled tubing workstring may be used for both reliably setting the whipstock assembly and for thereafter positioning and powering a downhole motor to rotate a mill which is diverted by the whipstock assembly to begin cutting a window in the casing string.

It is a feature of the invention that the whipstock assembly is provided with an outer wedge and an inner wedge at the upper end of the whipstock body. Each wedge is radially moveable with respect to the whipstock body from a run-in position to a set position. Each wedge may be locked in its set position once the whipstock assembly is properly positioned in the well, and may be subsequently unlocked to allow repositioning of the whipstock assembly to the run-in position for retrieval to the surface.

Another feature of the invention is that a hinge assembly at the lower end of the whipstock body allows a small diameter whipstock assembly to pass through a tubing string while being retained in the run-in position and then be set within a much larger diameter casing string. The hinge assembly may be released to its set position by pulling a rod upward with respect to the whipstock body. Once set, the hinge assembly may be returned to its run-in position for retrieving the whipstock assembly to the surface.

Another feature of the present invention is that upward movement of an elongate rod moveable with respect to the whipstock body may be used for both releasing a hinge assembly at the lower end of the whipstock body from its run-in position to its set position, and for releasing a wedge assembly at the upper end of the whipstock body from its run-in position to its set position.

A significant advantage of the present invention is the high reliability of properly setting a thru tubing whipstock within a casing string. The invention is highly versatile since the whipstock assembly may be set within a wellbore when suspended from either a coupled or coiled tubing workstring. The set whipstock may divert a starter mill, a conventional window cutting mill, a bit for drilling a lateral in a formation, or another downhole tool for performing a desired operation within the lateral. The rotatable mill or bit may be powered by a drill motor suspended from coiled tubing workstring in the casing string at a position below the tubing string.

It is a further feature of this invention that a thru tubing whipstock assembly of the type that passes through a small diameter tubing string and then is subsequently set in a significantly larger diameter casing string may include a lug at the upper end of the whipstock body for engagement with a starter mill. The starter mill may include a nose piece independently rotatable with respect to the cutters of the starter mill, so that the drilling operator may reliably determine that the starter mill has properly commenced the window cutting operation before retrieving the starter mill. A window mill may subsequently be used to cut the remaining portion of the lug off the whipstock body and finish cutting the window in the casing string.

These and further objects, features and advantages of the present invention will become apparent from the following detailed description, wherein reference is made to the figures in the accompanying drawings.

DETAILED DESCRIPTION OF THE PREFERRED EMBODIMENTS

Figure 1:
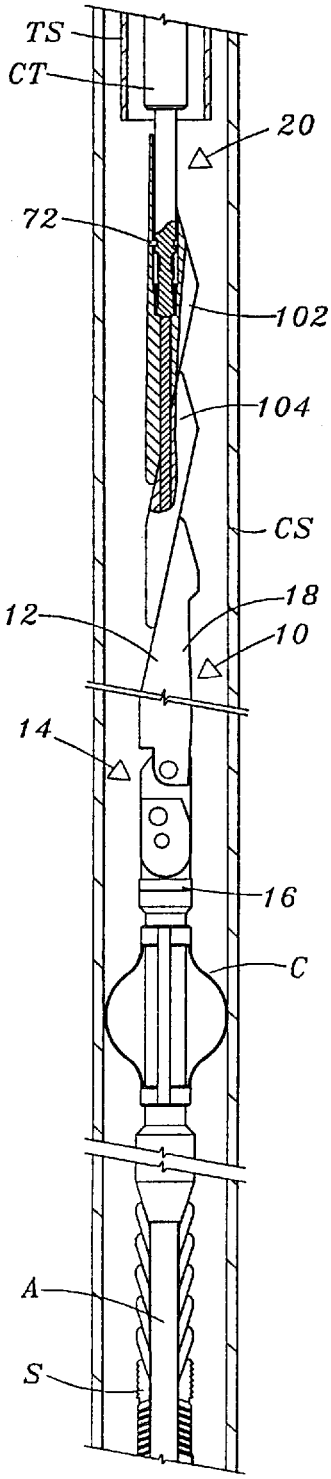
FIG. 1 is a simplified pictorial view of a whipstock assembly according to the present invention suspended within a casing string from coiled tubing workstring. The whipstock assembly is shown in its run-in position after having passed through a tubing string. The whipstock assembly is positioned below the tubing string and within the casing string at the depth desired for cutting a window in the casing string and subsequently drilling a lateral from the casing string.
Figure 2:
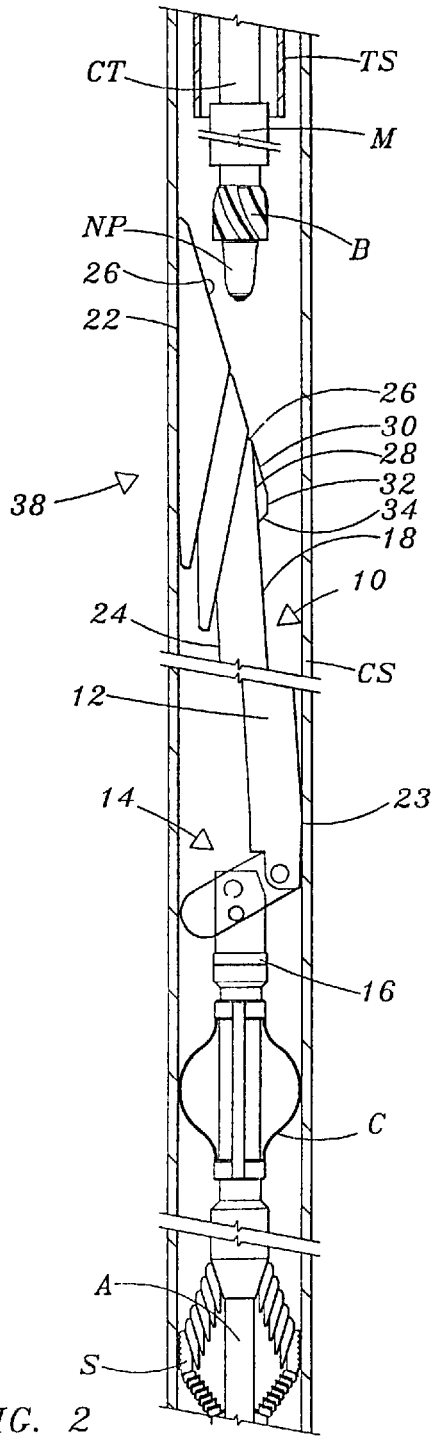
FIG. 2 is a simplified pictorial view of a whipstock assembly as shown in FIG. 1 after being set within the casing string. A bit or mill is depicted for engagement with the whipstock assembly to begin cutting the window in the casing string. The bit is powered by a downhole motor which is suspended within the casing string from coiled tubing workstring. Both the bit and the downhole motor are positioned within the casing string after passing through the lower end of the tubing string.

FIGS. 1 and 2 illustrate an exemplary application for a whipstock assembly 10 according to this invention for setting within a casing string CS after passing through a tubing string TS. The whipstock assembly 10 includes an elongate whipstock body 12, a hinge assembly 14 below the whipstock body, a sub 16 structurally interconnecting the hinge assembly 14 to a conventional bow spring centralizer C, and an anchor A. The components as shown in FIG. 1 are depicted in the run-in position for passing through the tubing string TS and for positioning at a desired axial location within the casing string CS, and are shown in the set position in FIG. 2 wherein the whipstock assembly 10 is supported by the anchor which is set in the casing string CS and serves to divert a bit or mill B.

The whipstock anchor A includes a plurality of slips S for engaging and securing the set whipstock assembly to the casing string CS. Conventional whipstock orientation and locating tools (not shown) may be used to position the whipstock assembly 10 at a desired axial location along the casing string CS and to desirably orient the whipstock face 18 for cutting a window at the intended azimuth. A whipstock orientation sub (not shown) may thus be positioned between the bow spring centralizer C and the anchor A. Further details regarding a suitable centralizer for a whipstock assembly, a whipstock anchor, and whipstock locating and orienting tools are disclosed in pending U.S. Ser. No. 08/409,276 filed on Mar. 23, 1995, now U.S. Pat. No. 5,595,247.

Those skilled in the art will appreciate that the whipstock assembly 10 of the present invention is particularly well suited for use in highly deviated and horizontal bore holes wherein the axis of the casing string CS at the position of the set whipstock is highly inclined with respect to a vertical axis or is substantially horizontal. As explained hereafter, the whipstock setting operation does not require that substantial compressive forces or rotational forces be transmitted to set the whipstock assembly 10. Accordingly, the whipstock assembly of the present invention may be positioned within a casing string CS by various means, and preferably by coiled tubing workstring. Those skilled in the art will appreciate that coiled tubing workstring operations are particularly well suited for applications involving highly deviated or horizontal wells provided that neither substantial compressive forces nor rotational forces need be transmitted to the downhole tools through the coiled tubing workstring. As explained in the above referenced patent application, the whipstock assembly may also be positioned in a casing string CS and set using a coupled workstring operation. Accordingly, those skilled in the art will appreciate that the casing string CS as shown in FIGS. 1 and 2 is depicted with a vertical axis for ease of illustration, and that the whipstock assembly and whipstock setting operation as described subsequently may be used for setting the whipstock within a casing string CS within a portion of a well which is highly inclined or is horizontal.

A particular feature of the present invention is that the whipstock assembly 10 is capable of passing through a relatively small diameter tubing string TS, and then may be reliably set within a relatively large diameter casing string CS with the whipstock face 18 being properly positioned within the casing string for cutting a window, as described hereafter. More particularly, the whipstock assembly of the present invention is capable of passing through a tubing string with an internal diameter which is less then one-half the internal diameter of the casing string in which the whipstock is set. In an exemplary application, the whipstock assembly 10 as shown in FIGS. 1 and 2 may be set within the casing string CS having an internal diameter of 8.535" after the whipstock assembly has been passed through a tubing string TS with an internal diameter of 3.695". Accordingly, the maximum diameter of the whipstock assembly 10 including the body 12, the hinge assembly 14, the sub 16, the centralizer C and the anchor A must be less than 3.695" so that the assembly may be passed through the tubing string. As shown in FIG. 2, the relatively small diameter whipstock assembly 10 may then be set within the casing string CS which has an internal diameter of more than twice the internal diameter of the tubing string.

The term "casing string" as used herein is intended in its broad sense to include any type of oilfield tubular string, and more particularly an oilfield tubular string comprising length or joints of casing interconnected by threaded collars. The term "tubing string" as used herein is also intended in its broad sense to include any type of oilfield tubular string which has an external diameter less than the internal diameter of the casing string, such that the tubing string may be fixed within the casing string as shown in FIGS. 1 and 2. In most applications, the tubing string will comprise lengths or joints of tubing interconnected by threaded collars or by oilfield pin and box connections. The term "coiled tubing workstring" as used herein is intended in its broad sense to include any type of continuous tubular which is significantly more flexible than the casing string or the tubing string, and generally is stored at the surface in reels and is unreeled as the coiled tubing workstring is extended down into the well.

Referring again to FIG. 1, the whipstock assembly 10 is illustrated in its run-in position after passing through tubing string TS. The whipstock assembly 10 is suspended within the casing string CS from coiled tubing workstring CT which extends to the surface of the well. A whipstock setting tool 20 is illustrated mechanically interconnecting the coiled tubing workstring CT with the whipstock body 12, and is discussed in further detail below. In practice, the whipstock body 12 will generally be axially much longer than depicted in FIGS. 1 and 2 relative to the other depicted components, and is shown axially shortened for ease of illustration. Those skilled in the art will appreciate that the whipstock assembly 10 may be positioned at any desired axial location within the casing string CS by the appropriate setting position or axial location of the anchor A. Prior to setting the whipstock assembly, the whipstock face 18 may be orientated in its desired circumferential position with respect to CS by controllably rotating the CT.

Referring now to FIG. 2, the whipstock face 18 is shown properly positioned within the CS for diverting a mill or a bit B to begin cutting a window in the CS. The hinge assembly 14 at the lower end of the whipstock body 12 and the wedge assembly 38 at the upper end of the whipstock body 12 are discussed in detail below. For the present, it should be understood that when the whipstock assembly 10 is set within the CS, a planar curved exterior convex surface 22 of the whipstock assembly is positioned circumferentially opposite the whipstock face 18 and is in planar engagement with the interior curved surface of the CS in order to provide a reliable planar support to minimize deflection of the whipstock body 12 once engaged by the bit B. Similarly, a front curved planar exterior convex surface 23 of the whipstock body 12 is positioned immediately below the whipstock concave face 18 and provides planar engagement with the CS at the circumferential location where the window is to be cut. The whipstock assembly 10 is thus reliably secured within the CS for diverting the bit B to begin cutting the window in the CS, to finish the window cutting operation in the CS, to pass a bit through a window in the CS for drilling a lateral in a formation exterior of the CS, or to perform various downhole operations within a lateral exterior of the CS.

In the set position, the whipstock body 12 includes a back exterior surface 24 at a position radially opposite the whipstock face 18 which is also inclined relative to the axis of the CS. The upper face 26 of the whipstock assembly 12 is inclined for initially engaging the nose piece NP of the bit B, and for initially guiding the tool, the window starter mill, or the bit B to engage the lug 28 secured to an upper end of the whipstock body 12. The lug 28 includes an upper inclined surface 30 for similarly guiding the bit B, a front surface 32, and an inclined surface 34 interconnecting the front surface 32 with the whipstock face 18.

As shown in FIG. 2, bit B is rotated by a downhole mud motor M, which in turn is suspended in the CS from coiled tubing workstring CT which extends from the surface of the well. The front surface 32 of the lug 28 is slightly inclined relative to the central axis of the casing string CS so that the nose piece NP of the bit B will become wedged between the lug 28 and casing string CS as the rotating bit B is lowered to begin cutting a window in the casing string CS. A particular feature of the present invention is that the whipstock assembly may be passed through a relatively small diameter tubing string TS and then reliably set in a much larger diameter casing string CS with both the whipstock face 18 and the lug 28 positioned within the CS so that the nose piece will become wedged between the lug 28 and the casing string CS. Once the nose piece NP has become wedged and cannot be further lowered, the torque required to rotate the bit B substantially decreases. This decreased torque may be readily detected at the surface by the well operator, who can then reliably determine the exact position of the bit B with respect to the set whipstock assembly 10. Equally important, the lug 28 serves the purpose of reliably ensuring the completion of the initial window cutting operation in the casing string CS so that the window starter mill may be retrieved to the surface and replaced with a conventional window cutting mill or mills, which then cuts the remaining portion of the lug 28 off the whipstock body 12 and finishes cutting the window in the casing string CS. Further details regarding the lug 28 and the mill or bit B with an independently rotatably nose piece NP are disclosed in pending U.S. Ser. No. 08/409,879 filed on Mar. 24, 1995, now U.S. Pat. No. 5,551,509.

Figure 3:
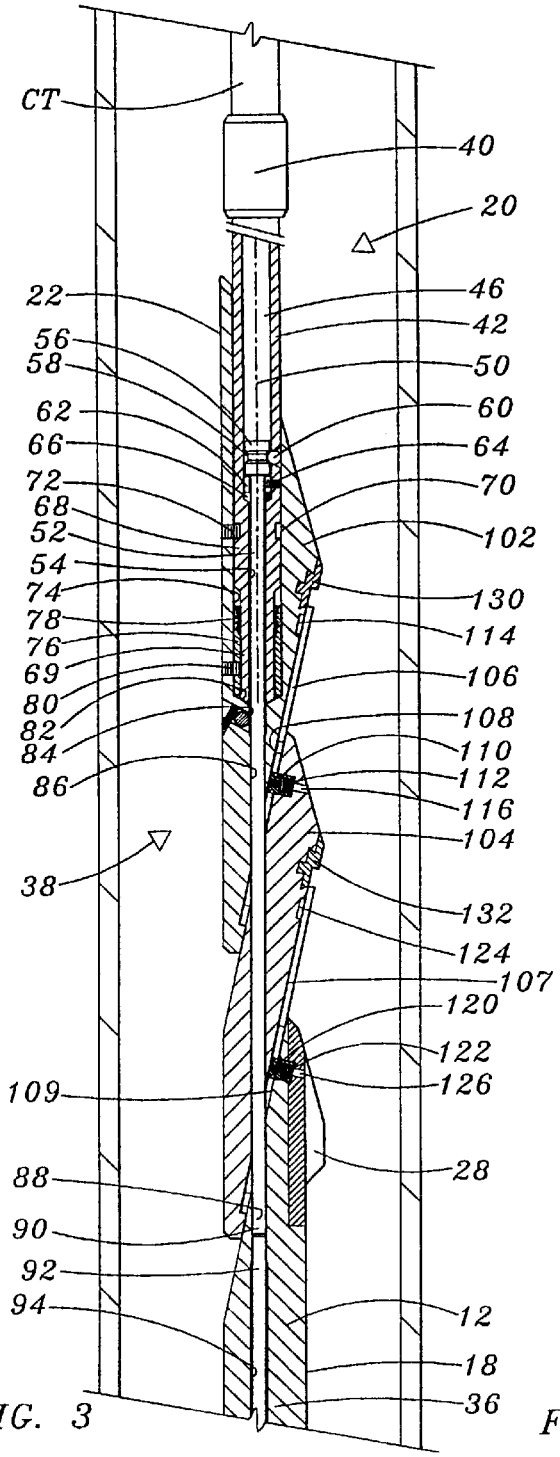
FIG. 3 is a cross-sectional view of an upper portion of the whipstock assembly as generally shown in FIG. 1 connected to the setting tool. The upper end of the whipstock assembly is shown in its run-in position and is suspended within the casing string from coiled tubing workstring.

Referring now to FIG. 3, the whipstock setting tool 20, the wedge assembly 38, and the upper portion of the whipstock body 12 are illustrated in greater detail in the run-in position. A conventional coiled tubing workstring sub 40 structurally interconnects a lower end of the CT with the setting tool 20, which is shown more clearly in FIG. 7. The setting tool includes an elongate sleeve 42 having threads 44 at its upper end for threaded engagement with the sub 40 and a bore 46 therethrough. The elongate sleeve 42 of the setting tool 20 has a central axis 50 which is generally aligned with the axis of the tubing string TS and the casing string CS when whipstock assembly 10 is run-in the well. An elongate rod 52 is positioned within a lower bore 54 at the end of the sleeve 42, with the rod 52 extending downward from the sleeve 42 as shown. A cylindrical cap 56 may be welded or otherwise secured to the upper end of the rod 52, with the cap 56 including an annular groove 58 therein. During run-in of the tool, one or more balls 60 or similar securing members fit within the tapered annular groove 58 and engages the wall of bore 103 in the upper wedge 102 (see FIG. 8) to secure the position of the rod 52 with respect to the sleeve 42. A sleeve-shaped spacer 62 is positioned about the rod 52 below the cap 56, with its position relative to the sleeve 42 being fixed by the set screw 64. Retaining member 66 engages the rod 52 and its function is discussed further below.

The bore 54 in sleeve 42 which receives the rod 52 has a diameter less than the bore 46 above the cap 56, thereby forming sleeve body portion 68, which has an annular groove 70 therein. One or more shear screws 72 (see FIG. 3) may interconnect the upper wedge member 102 with the sleeve 42 in a conventional manner. A reduced diameter sleeve portion 69 below the sleeve body 68 forms an annular recess with the cylindrical bore 74 in the upper wedge member 102. Sleeve 76 (see FIG. 3) substantially fills this annular recess and is secured to the upper wedge 102 by one or more set screws 80. The sleeve portion 69 is thus sized to fit within sleeve 76, with the lower chamfered surface 71 engaging the mating chamfered surface 77 in its upper wedge 102 to prevent shearing of screw 72 by compression if the whipstock assembly bumps an obstruction while being run in the well. The upper end of the sleeve 76 includes a plurality of interior latch surfaces or threads, which may comprise spiraling threads 78 as discussed below.

As shown in FIG. 3, upper wedge 102 defines a tapered wall 82 below the sleeve 76 and a socket 84 having a generally U-shaped configuration. Cylindrical bore 86 extends downward through the upper wedge 102 from the socket 84, and continues downward through a similar bore in the lower wedge 104 and through at least an upper portion of the whipstock body 12. Rod 52 thus extends downward through the bore 54 in the sleeve 42 and then through the bore 86 in the wedges 102 and 104, then into the bore in the whipstock body 12. A rod extension 92 is positioned within an elongate passageway 94 drilled in the body 12. The upper end of the rod extension 92 includes a shear portion 90 which is threadably connected to the rod 52 by threads 88. As shown in the lower portion of FIG. 3, central axis 50 of the setting tool 20 coincides with the central axis of the rod 52 and the rod extension 92. This axis 50 is preferably spaced closely to the central axis 36 of the casing string CS when the whipstock assembly 10 is in the run-in position, as shown in FIG. 3.

Figure 5:
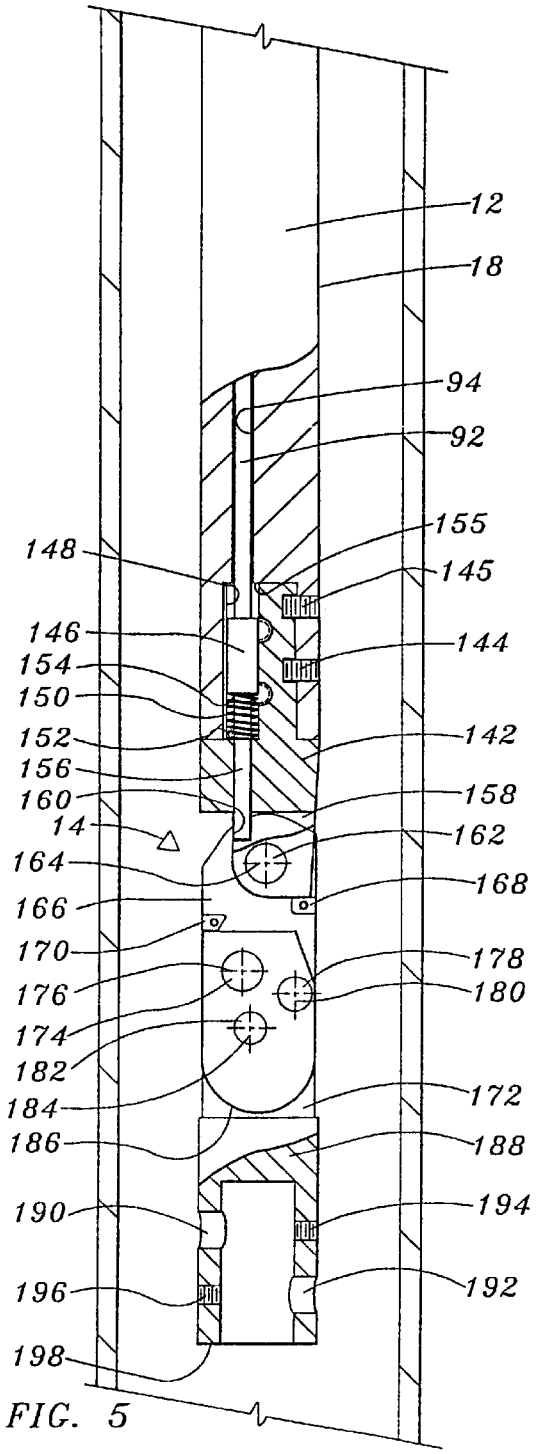
FIG. 5 is a cross-sectional view of a hinge assembly at the lower end of a whipstock body. The hinge assembly as shown in FIG. 5 is in its run-in position.
Figure 6:
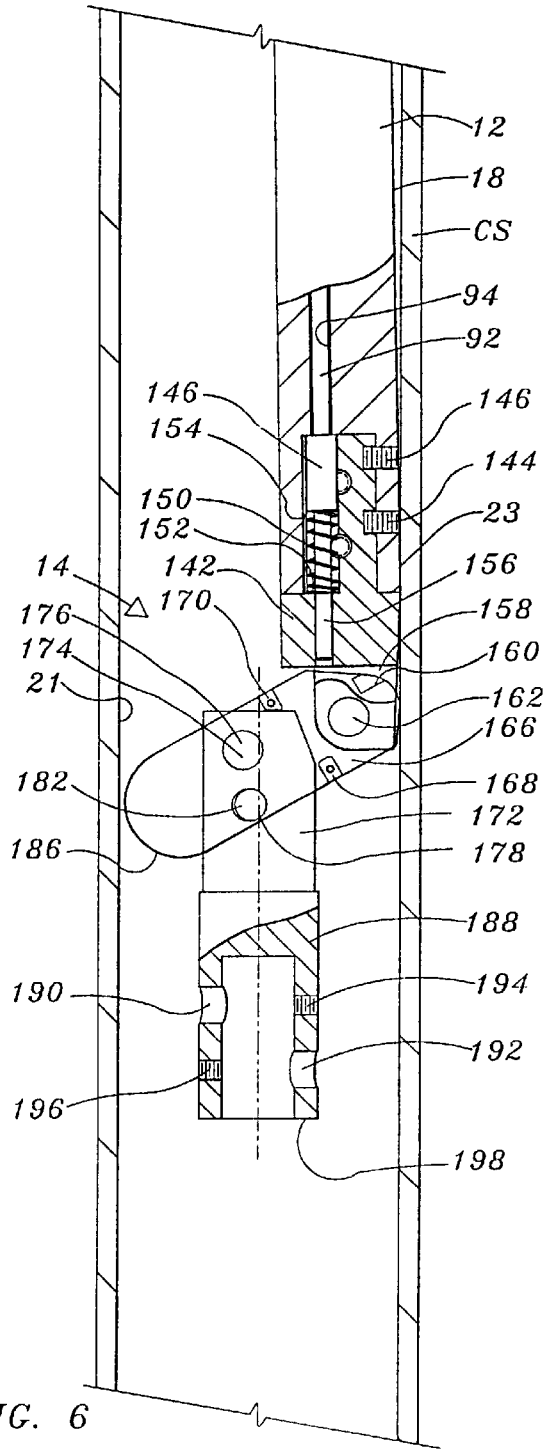
FIG. 6 is a cross-sectional view of the hinge assembly as shown in FIG. 5 in its set position.

Referring now to FIG. 5, the rod extension 92 is illustrated retaining the hinge assembly 14 in its run-in position. Lower whipstock body block 142 is mounted to the lower end of the whipstock body 12 by a plurality of conventional securing members 144 and 145. Curved planar surface 23 of the whipstock body configured for planar engagement with the casing string is also shown in FIG. 5. A cylindrical stop 146 at the lower end of the rod extension 92 is received within a cylindrical bore 148 in the block 142. Coil spring 150 is spaced between the support surface 152 on the block 142 and the lower surface 154 of the stop 146 and biases the stop 146 axially upward toward the upper stop surface 155. The rod extension 156 extends downwardly from the stop 146, and the lower end of rod extension 156 is received within the cylindrically shaped socket 160 in the hinge arm 166. Hinge arm 166 is interconnected with the block 158 by pin 162, so that the arm 166 rotates clockwise as shown in FIGS. 5 and 6 about axis 164 with respect to the block 158. The lower end of extension rod 156 thus engages the hinge arm 166 to prevent rotation of the hinge arm about axis 164 when the whipstock assembly is in the run-in position. When the whipstock assembly is in the run-in position, stop member 168 secured to the hinge arm 166 also engages or is closely adjacent the lower surface of block 158, and stop 170 also secured to the hinge arm 166 engages or is closely adjacent the upper surface of block 172, as shown in FIG. 3. Hinge arm 166 is pivotably connected to the block 172 by pin 174, so that the arm 166 also rotates clockwise as shown in FIGS. 5 and 6 about axis 176 with respect to block 172. Pin 178 having a central axis 180 is also secured to the arm 166. Cylindrical bore 182 having a central axis 184 is provided within the block 172. The lowermost end of the arm 166 includes curved exterior surface 186, which is also shown in FIG. 6.

Inverted cup-shaped member 188 extends downward from and preferably is integral with the block 172. The sleeve shaped sidewalls of the cup member 188 include a plurality of ports 190 and 192, as well as threaded ports 194 and 196. An upward central projection (not shown in FIG. 3) of the sub 16 as shown in FIGS. 1 and 2 fits within the cylindrical bore 200 of the inverted cup member 188. Sub 16 may thus be secured to the inverted cup member 188 and the block 172 by a plurality of set screws and bolts (not shown) which fit within the threaded ports 194 and 196. Lower surface 198 of the inverted cup member 188 engages a mating stop surface (not shown) on the sub 16.

Referring now to FIG. 6, it may be understood that if the rod extension 92 is allowed to move upward within the passageway 94 in the whipstock body 12, coil spring 150 will push the stop member 146 upward to engagement with the upper stop surface 155, thereby lifting the rod extension 156 out of the cylindrical shaped socket 160 in the arm 166. This action, in turn, will allow the arm 166 to rotate clockwise as shown in FIGS. 5 and 6 about axis 164 relative to the block 158, thereby pivoting the arm 166 from the run-in position as shown in FIG. 5 to the set position as shown in FIG. 6. The curved planar surface 23 will thus engage the interior surface of the CS as the circumferential position corresponding to the location where the window is to be cut in the CS. Upon lifting the rod extension 156 out of the socket 160, the hinge arm 166 is also free to rotate clockwise as shown in FIGS. 5 and 6 about axis 176 with respect to block 172, thereby shifting curved exterior surface 186 radially closer to the interior surface 21 of the casing string CS radially opposite the location where the window is to be cut.

It may be seen in FIG. 6 that the curved exterior surface 186 is moved into engagement with the surface 21, so that the arm 166 is essentially sandwiched between radially opposing surfaces of the casing string. It should be understood that when the hinge assembly 14 is in the set position, the weight of the whipstock body 12 pressing downward on the pin 162 may be sufficient to retain the arm 166 in the set position, as shown in FIG. 6. Referring to FIGS. 5 and 6, rotation of the arm 166 relative to the block 172 also causes the pin 178 to be generally aligned with the cylindrical port 182 in the block 172. The pin 178 may be moveable relative to the arm 166 and may be biased by a coil spring (not shown) so that it snaps within the cylindrical hole 180 in the block 172 when the arm 166 is rotated to the FIG. 6 position. A tapered end of the pin 178 may allow the pin to be retracted from the hole 180 if a sufficient upward force is exerted on the whipstock body 12, as described subsequently. Alternatively, the pin 178 may be biased toward sliding within hole 180 by a spring, and may be sized to shear when a sufficient upward force is exerted on the whipstock body 12.

Figure 4:
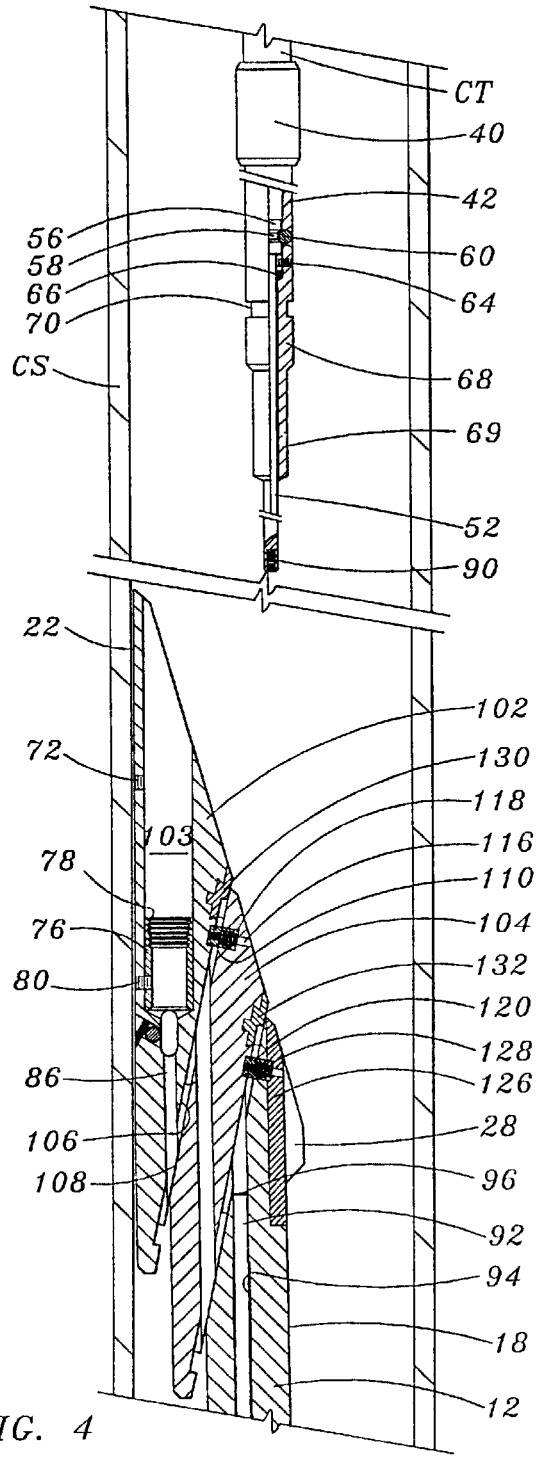
FIG. 4 is a cross-sectional view of the upper portion of the whipstock assembly in a set position within the casing string and released from the setting tool. The lower end of a whipstock setting tool is shown in FIG. 4 structurally disconnected from the set wedge assembly at the upper end of the whipstock body.
Figure 7:
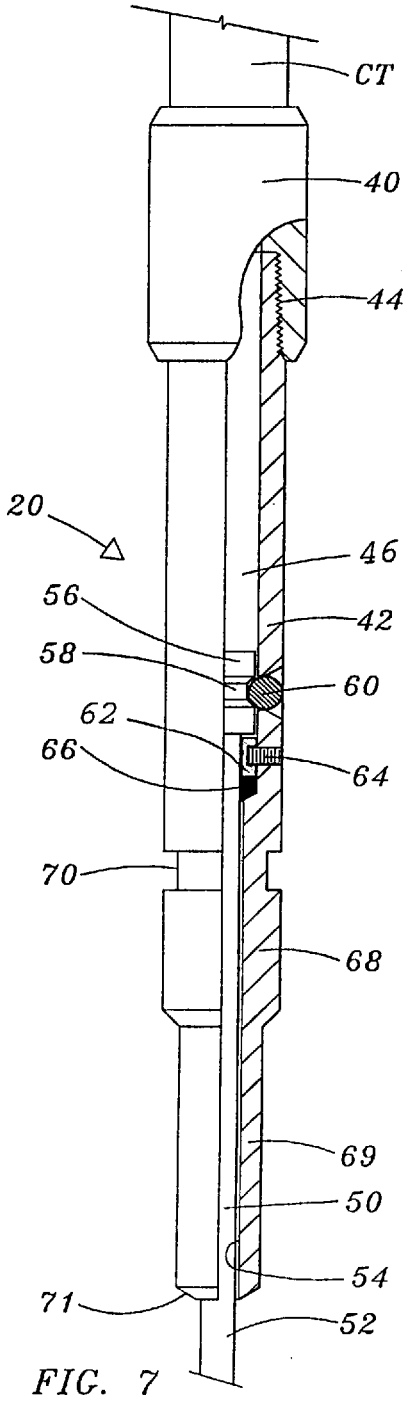
FIG. 7 is a detailed cross-sectional view of the setting tool generally shown in FIGS. 3 and 4.

Referring again to FIGS. 3, 4 and 7, after releasably latching the whipstock to the anchor, an upward tensile force applied to the CT will be transmitted through the whipstock actuating tool 20 and the rod 52 to the pin 90 at the upper end of the rod extension 92. The pin 90 is sized for shearing at a selected tensile force, and accordingly an upward force applied by the operator at the surface to the CT will shear the pin 90 from the rod extension 92, and shown in FIG. 4, thereby allowing the coiled tubing workstring CT and the whipstock setting tool 20 as shown in FIG. 7 to be retrieved to the surface through the tubing string TS. More particularly, the required tensile pull on the CT may be determined by the shearing force of one or more shear pins 72 which interconnect the upper wedge 102 with the sleeve 42, as shown in FIG. 4. The force required to shear the pin 90 may thus be significantly less than the force required to shear the one or more pins 72, so that shearing of the pins 72 will inherently shear the pin 90, thereby allowing upward movement of the tool 20 relative to the whipstock body 12. It should now be understood that the rod 52 as shown in FIG. 3 prevents coil spring 150 as shown in FIG. 5 from moving the rod extension 92 upward while the whipstock assembly is in the run-in position. Once the pin 72 shears, however, and the rod 52 is moved upward relative to the whipstock body 12, spring 150 moves the rod extension 92 upward in the passageway 94 in the body 12, thereby allowing the hinge assembly to rotate from the run-in position as shown in FIG. 5 to the set position as shown in FIG. 6.

As the coiled tubing workstring CT is retrieved to the surface with the whipstock actuating tool 20 at the lower end thereof, the rod 52 will thus be pulled upward out of the bore 86 in the upper wedge 102, the lower wedge 104, and the upper portion of the whipstock body 12. The removal of the rod 52 thus allows the upper wedge 102 and the lower wedge 104 to move to the set position, as shown in FIG. 4. More particularly, upward movement of whipstock actuating tool 20 with respect to the upper wedge 102 will result in the balls 60 as shown in FIG. 7 rising out of the bore 103 in the upper wedge 102, thereby allowing the rod 52 to move upward within the bore 46. As long as the coiled tubing workstring is being pulled upward, however, the cap 56 will remain in engagement with the spacer 62.

Figure 8:
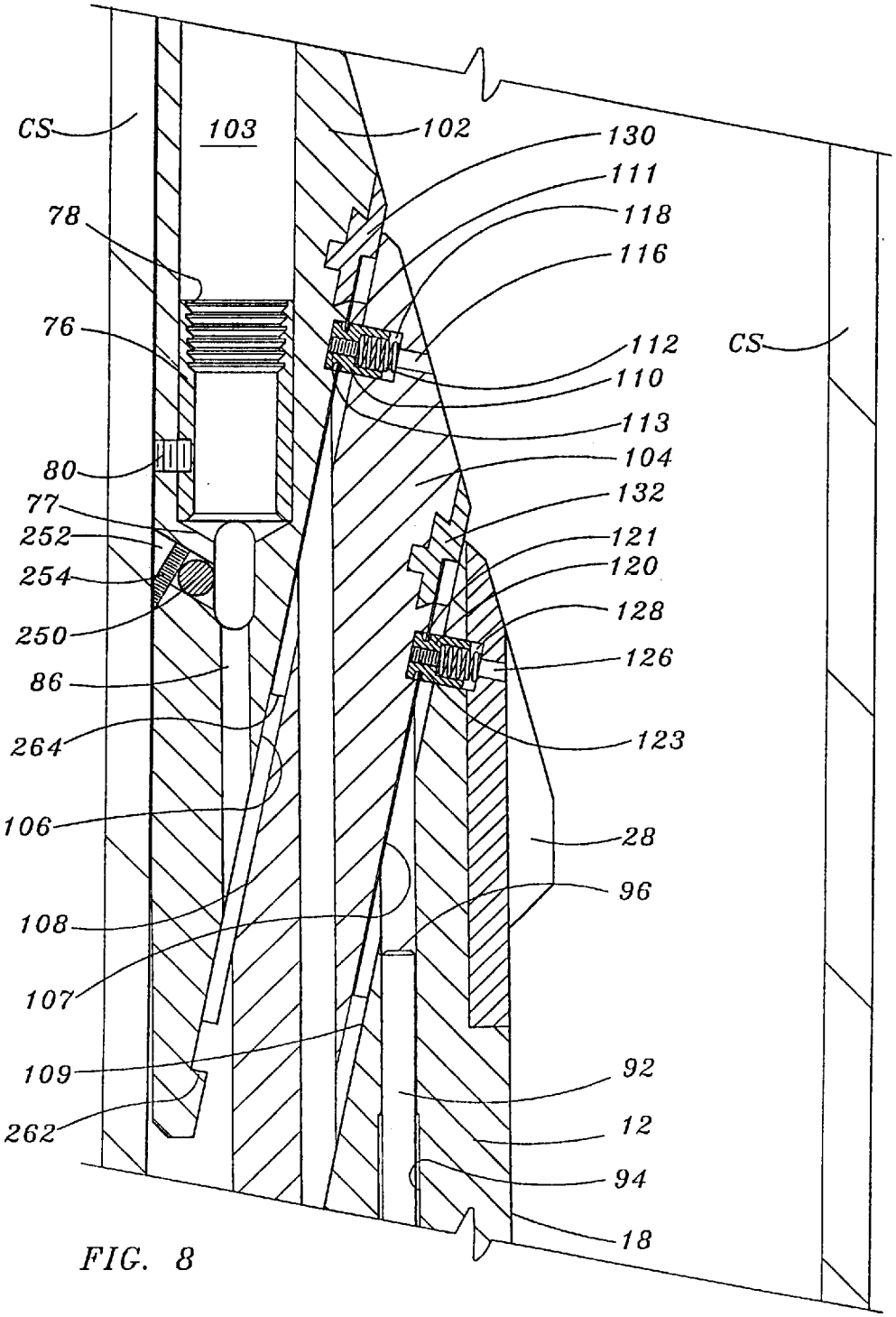
FIG. 8 is a detailed cross-sectional view of the upper portion of the whipstock assembly in the set position as shown in FIG. 4.

In some applications, particularly those involving horizontal or highly deviated wells, gravity may not be sufficient to move the wedges 102 and 104 to the set position, as described subsequently. Accordingly, it is desirable to allow a nominal axial compressive force to be transmitted through the coiled tubing workstring CT and the tool 20 to move the wedges from the run-in position to the set position. Referring now to FIG. 8, as the lower end of the rod 52 rises out of the bore 86 and passes upward out of the sleeve 76, ball member 250 slightly larger in diameter than bore 86 is positioned within inclined passageway 252 in the upper wedge 102, and is free to drop into the lower end of retrieving port 103 below sleeve 76, and will engage and plug the top of bore 86. Accordingly, a downward force may be applied to the coiled tubing workstring and through the tool 20 to move the wedge members to the set position, as described hereafter, with the rod 52 being prevented by the ball 250 from inadvertently re-entering the bore 86. Instead, the lower end of the rod 52 will engage the ball member 250 and the rod 52 will move upward within the bore 46 and within the coiled tubing workstring. The rod 52 will be retained in this upward position relative to the sleeve 42 by frictional engagement with the rubber retaining member 66. A downward force sufficient to move the wedge members to the set position may thus be transmitted through the sleeve 42 and between the chamfered surfaces 71 and 77, thereby moving the wedge members to the set position. A pin or similar stop member 254 as shown in FIG. 8 will prevent the ball 250 from moving out of the passageway 252 during run in of the tool. By allowing the rod 52 to move upward while a slight compressive force is applied to the upper wedge 102, the wedge members may be reliably moved to the set position without risk that the rod 52 will re-enter the passageway 86 to prevent the wedge members from moving to the set position, and without bending the rod 52.

Referring now to FIGS. 3, 4 and 8, the lower face 106 of the upper wedge 102 and the upper face 108 of the lower wedge 104 include a conventional dovetail interconnection for allowing sliding movement of the upper wedge 102 relative to the lower wedge 104 once the rod 52 is removed. A stop member 130 is secured to the upper wedge 102 as shown in FIGS. 4 and 8, and also has a dovetail configuration with the dovetail of the stop member 130 being at a right angle with respect to the dovetail between the upper wedge 102 and the lower wedge 104. The stop member 130 does not move relative to the body 12, and merely serves as a stop to limit the sliding movement of the upper wedge 102 relative to the lower wedge 104 when the whipstock assembly is moved to the set position. Upon removal of the rod 52, it is to be understood that the weight of the wedge 102 may generally be sufficient to cause the wedge 102 to slide relative to the wedge 104 and move from the position as shown in FIG. 3 to the position as shown in FIG. 4. A lower surface 107 of the lower wedge 104 and an upper surface 109 of the whipstock body 12 have a similar dovetail connection which allows sliding movement of the lower wedge 104 relative to the body 12. Also, a dovetail stop 132 secured to the lower wedge as shown in FIGS. 4 and 8 serves as a stop to limit sliding movement of the lower wedge 104 relative to the whipstock body 12.

As shown in FIGS. 3, 4 and 8, a first locking member 110 mounted on and moveable relative to the lower wedge 104 is providing for fitting within the recess 114 in the upper wedge 102 to lock the position of the upper wedge 102 relative to the lower wedge 104 when the components are moved to the set position, as shown in FIGS. 4 and 8. The locking member 110 is biased for movement into the recess 114 by coil spring 112. During shipment of the tool, the position of a locking member 110 may be fixed in a retracted position relative to the upper wedge 102 by securing a jack screw in thread 113 installed through port 116. Once the whipstock assembly 10 is ready to be run-in the well, the conventional tool may be inserted into the port 116 for unthreading and removal of the jack screw, and thereby allowing sliding movement of the locking member 110 relative to the upper wedge 102 before the rod 52 is positioned in bore 86. When the upper wedge 102 is moved to the set position as shown in FIGS. 4 and 8 relative to the lower wedge 104, spring 112 thus biases the locking member 110 into the recess 114, thereby forming a gap 118 between the locking member 110 and the wedge 104. A locking member 120 mounted on the upper end of the whipstock body 12 is functionally similar to the locking member 110, and is biased by spring 122 for engagement with the recess 124 in the lower wedge 104 once the lower wedge is moved to the set position relative to the whipstock body 12, as shown in FIGS. 4 and 8. As a backup to the locking members 110, 120, the sliding movement of both the upper wedge and the lower wedge to the set position as shown in FIG. 8 is limited by stop 130 on the upper wedge "bottoming out" on the lower wedge, and by stop 132 on the lower wedge similarly "bottoming out" on the whipstock body. Accordingly, it should be understood that an upward tensile force on the CT will cause the hinge assembly 14 to pivot from the run-in position as shown in FIG. 5 to the set position as shown in FIG. 6, and shortly thereafter (or simultaneously therewith) will also cause the wedge assembly 38 to move from the run-in position as shown in FIG. 3 to the set position as shown in FIG. 4. Both the hinge assembly 14 and the wedge assembly 38 may then be retained in the set position by the locking members 178, 110 and 120, as discussed above.

Figure 9:
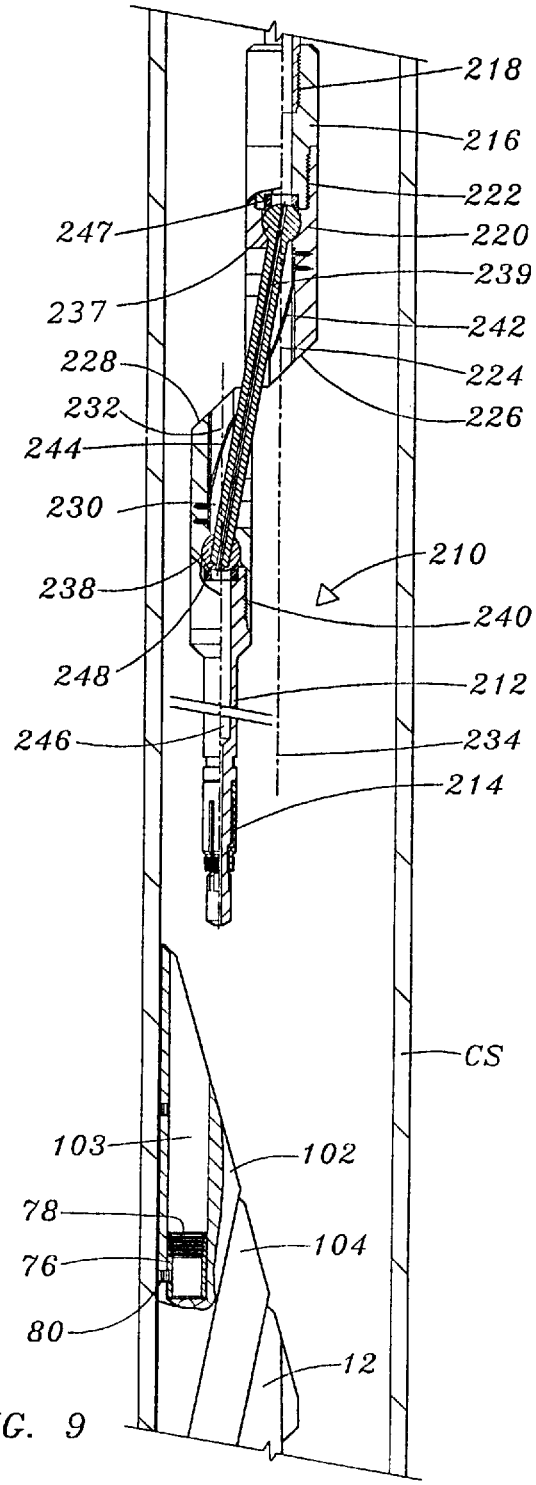
FIG. 9 is a cross-sectional view of the upper portion of the whipstock in the set position within a casing string and a retrieval tool for engagement with the whipstock.

Once the window has been cut in the casing, the lateral formation has been drilled to its desired extent radially outward from the casing string CS, and/or the desired downhole operation within the lateral has been conducted, it may be desirable to retrieve the whipstock assembly 10 from the casing string CS through the tubing string TS. In order to unset the whipstock assembly 10, a retrieval tool 210 as shown in FIG. 9 may be lowered from coiled tubing workstring, with the retrieval tool having a downward extending rod 212 with lower latch teeth 214 thereon for mating engagement with the latch surfaces 78 in the sleeve 76. The downwardly extending rod of the whipstock retrieval tool 210 may thus be positioned within the bore 104 in the upper and radially outer wedge 102 as shown in FIGS. 8 and 9, and the unsetting rod 212 then structurally interconnected with the sleeve 76 and thus with the upper wedge 102 by mating engagement of latch teeth 214 with surfaces 78. Once this structural interconnection has been made, an upward force may be applied to the coiled tubing workstring sufficient to shear the locking member 110 in the area of the shear groove 111 (see FIG. 8), and similarly to shear the locking member 120 in the area of the shear groove 121. Upon shearing of the locking members 110 and 120, an upward force on the coiled tubing workstring CT will then allow the wedge 102 to slide relative to the wedge 104, and will similarly allow the wedge 104 to slide relative to the whipstock body 12, thereby returning the upper wedge 102 and lower wedge 104 to the run-in position as shown in FIG. 3. The latch surfaces 78 and mating teeth 214 are configured so that, if necessary, right hand rotation of the retrieval tool 210 will cause the teeth 214 to be released from the latch surfaces 78.

The upward force on the CT transmitted through the retrieval tool 210 to the upper wedge as described above will also be transmitted to the whipstock body 12 after the surface 266 on the upper wedge 102 as shown in FIG. 8 engages the stop surface 264 on the lower wedge 104, and a similar surface on the lower wedge engages a similar stop surface on the whipstock body 12. The upward force on the coiled tubing workstring CT transmitted through the whipstock body 12 will thus exert an upward force on the pin 162, which in turn will compress the spring (not shown) which retains the pin 178 within the cylindrical recess or hole 180 as shown in FIG. 6. Alternatively, the upward force may shear the selectively sized pin 178, as explained above. Once the pin 178 has been retracted from the cylindrical hole 180 (or shears) in response to the upward force, the hinge arm 166 will rotate back to the position substantially as shown in FIG. 5 relative to the body 12 and the block 172. The lower end of the arm extension 156 will remain out of engagement with the socket 160 due to the biasing force of the spring 150. The arm 166 will thus rotate to substantially the position as shown in FIG. 3, with the rotation being limited by the stops 168 and 170. Since the axis 164 of the pin 162 is spaced horizontally from the axis 176 of the pin 170, an upward force exerted on the coiled tubing workstring and thus transmitted to the whipstock body 12 will retain the arm 166 in the run-in position relative to the body 12 and the block 172. Once the wedge assembly 38 and the hinge assembly 14 have been returned to the run-in position, the whipstock assembly 10 may then be retrieved to the surface through the tubing string TS.

As shown in FIG. 9, the retrieval tool 210 includes an upper sub 216 with threads 218 for interconnection with a bow spring centralizer (not shown) which is interconnected with the tubing string. Upper body 220 is interconnected with the sub 216 by threads 222. Bore rod 212 is connected to the lower housing 230 by threads 240. The upper housing 220 includes a central bore 224 therein and lowered angled surface 226 for sliding engagement with the upper angled surface 228 of a lower housing 230. Lower housing 230 also has a central bore 232. When the retrieval tool is run-in the well, the bores 224 and 232 can be substantially aligned with the central axis 234 of the retrieval tool 210. During run-in, rod 236 fills the passageways 224 and 232 to centralize the tool for passing through a small diameter tubing string.

After passing through the tubing string and being lowered into the casing string CS, the biasing action of leaf springs 242 in bore 224 and 244 in bore 232 automatically move the tool to the position shown in FIG. 9, so that the rod 212 is offset from the axis 234. The rod 212 may thus pivot so that the lower end of the rod 242 is axially aligned with the bore 103. A conventional indexing sub (not shown) may be provided above the centralizer for rotating the offset axis of the rod 212 circumferentially about the central axis of the casing string, or a coupled work string may be rotated to align the offset rod 212 with the bore 103. Once properly positioned circumferentially, the setting tool 210 may be lowered so that the latch teeth 214 lock with surfaces 78 to interconnect tool 210 and whipstock 10. Offsetting the rod 212 to the position as shown in FIG. 9 is accomplished by providing ball members 237 and 238 at the upper and lower end of the rod 236 for pivoting within respective sockets within the upper housing 220 and the lower housing 230 in response to the biasing force of springs 242 and 244.

Both the lower end of the upper housing 220 and the upper end of the lower housing 230 include an angled slot therein for receiving the rod 236 when the rod is pivoted to the position as shown in FIG. 9 by the springs 242 and 244. Bore 239 in the rod 238 maintains fluid communication between the interior of the coiled tubing workstring and the bore 246 in the rod 212. Seats 247 and 248 seal with the respective ball members 237 and 238. The bores 239 and 246 thus allow pressurized fluid to be pumped through the coiled tubing workstring and out the bottom of the retrieval tool 210 to wash out the bore 103, if required, so that the latch teeth 214 may engage the latch surfaces 78.

Various modifications to the whipstock assembly as described herein will be suggested from the above description. Those skilled in the art will appreciate that one or more wedge members may be used in the wedge assembly at the upper end of the whipstock body 12. More than two wedge members may practically be necessary if, for example, the whipstock assembly is intended to be set in a casing string which is three times or more greater in diameter than the diameter of the tubing string through which the whipstock assembly is passed. Also, those skilled in the art will appreciate that various mechanisms may be used to slidably interconnect the one or more wedge members with the whipstock body or with each other. Also, various locking members may be used to lock the position of the one or more wedge members with respect to each other or with respect to the whipstock body. Various techniques may also be used for thereafter unlocking the locking members to allow the wedge assembly to be returned to the run-in position for retrieving the whipstock assembly to the surface through the tubing string.

Those skilled in the art will also appreciate that various mechanisms may be used for retaining the one or more wedge members in the run-in position, and for thereafter moving or deactivating the retaining member for allowing the wedge members to move to the set position. Similarly, various devices may be used for retaining the hinge assembly in the run-in position, and for releasing the hinge assembly to move to the set position when it is desired to set the whipstock assembly in the well. Various locking mechanisms other than a pin may be used to lock the hinge assembly in the set position, and for thereafter allowing the release or unlocking of the hinge assembly so that it may be returned to the run-in position for retrieving the whipstock assembly through the tubing string. The anchor may be part of the whipstock assembly which is run-in with the whipstock body. Alternatively, a whipstock anchor may be set in the casing string then the whipstock body run-in the casing string through the tubing string and then supported on the set anchor.

The foregoing disclosure and description of the invention is illustrative and explanatory thereof. It will be appreciated by those skilled in the art that various changes in the size, shape and materials as well as in the details of the illustrated construction or combinations of features discussed herein may be made without departing from the spirit of the invention. Modifications to the procedure for setting and for retrieving the whipstock assembly, optionally through the tubing string, will also be suggested from the above description. While the whipstock as disclosed herein is well suited for cutting a window in a casing string, those skilled in the art will appreciate that the whipstock may be used for any downhole operation wherein a tool is deviated from the path in the primary borehole which contains the casing string. The whipstock may thus be used to divert a drill bit to drill a lateral from the casing string, or may be used to position a tool within the lateral for performing a desired downhole operation. Accordingly, the scope of the invention is as defined by the following claims.

What is claimed is:

1. A thru tubing whipstock assembly for setting within a casing string on an anchor for securing the set whipstock assembly within the casing string after passing through a lower end of a tubing string positioned within the casing string, the whipstock assembly being settable within the casing string to divert a tool with respect to the casing string, the whipstock assembly comprising:

an elongate whipstock body having a whipstock face for diverting the tool;

a hinge assembly positioned between the whipstock body and the anchor for pivoting from a run-in position for passing the whipstock assembly through the tubing string to a set position for positioning the whipstock face for engagement with the tool; and a wedge assembly at an upper end of the whipstock body for moving from a run-in position for passing the whipstock assembly through the tubing string to a set position for positioning the whipstock face for engagement with the tool, the wedge assembly including at least one wedge member supported on and radially moveable with respect to the whipstock body from a radially inward run-in position to a radially outward set position for engagement of the at least one wedge member with the casing string and thereby radially space the upper end of the whipstock body from an interior surface of the casing string.

2. The whipstock assembly as defined in claim 1, further comprising:

the tool is a rotatable mill for cutting a window in the casing string; and a lug secured to an upper end of the whipstock body for engagement with the mill for initially cutting the window in the casing string.

3. The whipstock assembly as defined in claim 2, wherein the wedge assembly is sized for positioning the lug within the casing string such that a nose piece independently rotatable with respect to cutters on the mill is wedged between the lug and an interior surface of the casing string after the window has been initially cut by the mill.

4. The whipstock assembly as defined in claim 1, wherein the wedge assembly comprises:

an upper wedge member radially moveable with respect to the whipstock body from the run-in position to the set position; and a lower wedge member radially moveable with respect to the whipstock body from the run-in position to the set position, the lower wedge member being sandwiched between the upper wedge member and the whipstock body when the wedge assembly is set within the casing string.

5. The whipstock assembly as defined in claim 4, further comprising:

a first dovetail interconnection between a lower face of the upper wedge member and an upper face of the lower wedge member for slidably interconnecting the upper wedge member and the lower wedge member; and a second dovetail interconnection between a lower face of the lower wedge member and an upper face of the whipstock body for slidably interconnecting the lower wedge member to the whipstock body.

6. The whipstock assembly as defined in claim 4, further comprising:

a first locking member for fixing the position of the upper wedge member with respect to the lower wedge member when the wedge assembly is in the set position; and a second locking member for fixing the position of the lower wedge member with respect to the whipstock body when the wedge assembly is in the set position.

7. The whipstock assembly as defined in claim 1, further comprising:

an elongate bore passing through the at least one wedge member and at least a portion of the whipstock body; and a rod for fitting within the elongate bore to prevent radial movement of the at least one wedge member with respect to the whipstock body when the wedge assembly is in the run-in position.

8. The whipstock assembly as defined in claim 7, further comprising:

a whipstock setting tool for exerting an upward force on the rod to move the rod within the bore and thereby release the wedge assembly from the run-in position to the set position.

9. The whipstock assembly as defined in claim 7, further comprising:

an elongate passageway within the whipstock body extending from an upper end of the whipstock body to the lower end of the whipstock body adjacent the hinge assembly; and a rod extension within the passageway for preventing pivoting movement of the hinge assembly with respect to the whipstock body when the wedge assembly is in the set position, and for thereafter moving with respect to the whipstock body to selectively release the hinge assembly from the run-in position to the set position.

10. The whipstock assembly as defined in claim 9, further comprising:

a biasing member for biasing the rod extension to the set position.

11. The whipstock assembly as defined in claim 1, wherein the wedge assembly comprises:

a plurality of wedge members each radially moveable with respect to the whipstock body from the run-in position to the set position;

a lower one of the plurality of wedge members being sandwiched between an adjoining upper one of the plurality of wedge members and the whipstock body when the wedge assembly is set within the casing string;

one or more interconnections each between a lower face of an upper one of the plurality of wedge members and an upper face of the lower one of the plurality of wedge members for slidably interconnecting the upper one of the plurality of wedge members and the lower one of the plurality of wedge members; and a lower one of the plurality of interconnections between a lower face of the lower one of the plurality of wedge members and an upper face of the whipstock body for slidably interconnecting the lower one of the plurality of wedge members to the whipstock body.

12. The whipstock assembly as defined in claim 11, further comprising:

a plurality of locking members for fixing the position of each of the plurality of wedge members when the wedge assembly is in the set position.

13. The whipstock assembly as defined in claim 1, further comprising:

a locking member for fixing the position of the at least one wedge member with respect to the whipstock body when the wedge assembly is in the set position; and a releasing member to release the locking member to move the wedge assembly from the set position to the run-in position.

14. The whipstock assembly as defined in claim 1, wherein the hinge assembly includes a hinge arm rotatably connected to the anchor and rotatably connected to a lower end of the whipstock body, the hinge arm including an exterior surface for engagement with the interior surface of the casing string when the hinge assembly is in the set position.

15. The hinge assembly as defined in claim 14, further comprising:

a stop member for preventing rotation of the hinge arm with respect to the anchor when the wedge assembly is in the run-in position.

16. The method as defined in claim 1, wherein the hinge assembly includes a hinge arm rotatably connected to the whipstock anchor and rotatably connected to a lower end of the whipstock body; and rotating the hinge arm to the set position such that an exterior surface of the hinge arm is in engagement with the interior surface of the casing string when the wedge assembly is in the set position.

17. A thru tubing whipstock assembly for suspending within a casing string from coiled tubing workstring and for setting within the casing string after passing through a lower end of a tubing string positioned within the casing string, the whipstock assembly being settable within the casing string to divert a tool with respect to the casing string, the whipstock assembly comprising:

an elongate whipstock body having a whipstock face for diverting the tool;

a whipstock setting tool for releasably attaching the whipstock body to the coiled tubing workstring and for moving the whipstock body from a run-in position for passing the whipstock assembly through the tubing string to a set position for positioning the whipstock face for engagement with the tool;

a hinge assembly positioned below the whipstock body for pivoting from the run-in position to the set position; and a wedge assembly at an upper end of the whipstock body for moving from a run-in position for passing the whipstock assembly through the tubing string to a set position for positioning the whipstock face for engagement with the tool, the wedge assembly including an upper wedge member radially moveable with respect to the whipstock body from the run-in position to the set position, and a lower wedge member radially moveable with respect to the whipstock body from the run-in position to the set position, the lower wedge member being sandwiched between the upper wedge member and the whipstock body when the wedge assembly is set within the casing string.

18. The whipstock assembly as defined in claim 17, further comprising:

a first interconnection between a lower face of the upper wedge member and an upper face of the lower wedge member for slidably interconnecting the upper wedge member and the lower wedge member; and a second interconnection between a lower face of the lower wedge member and an upper face of the whipstock body for slidably interconnecting the lower wedge member to the whipstock body.

19. The whipstock assembly as defined in claim 17, further comprising:

a locking member for fixing the position of the upper wedge member with respect to the lower wedge member when the wedge assembly is in the set position.

20. The whipstock assembly as defined in claim 17, further comprising:

an elongate bore passing through the upper wedge member, the lower wedge member, and at least a portion of the whipstock body; and a rod for fitting within the elongate bore to prevent radial movement of the upper wedge member and lower wedge member with respect to the whipstock body when the wedge assembly is in the run-in position.

21. The whipstock assembly as defined in claim 20, further comprising:

an elongate passageway within the whipstock body extending from an upper end of the whipstock body to the lower end of the whipstock body adjacent the hinge assembly; and a rod extension within the passageway for preventing pivoting movement of the hinge assembly with respect to the whipstock body when the wedge assembly is in the set position, and for thereafter moving with respect to the whipstock body to selectively release the hinge assembly from the run-in position to the set position.

22. The whipstock assembly as defined in claim 17, further comprising:

a connector for interconnection with a whipstock retrieval tool to unset the wedge assembly for retrieval of the whipstock assembly through the tubing string.

23. A method of setting a thru tubing whipstock assembly within a casing string after passing the whipstock assembly through a lower end of a tubing string positioned within the casing string, the whipstock assembly being moveable to a set position within the casing string to divert a tool with respect to the casing string, the method comprising:

setting a whipstock anchor to secure the whipstock assembly within the casing string with an elongate whipstock body above the anchor for diverting the tool;

activating a hinge assembly positioned between the whipstock body and the anchor for pivoting the whipstock body from a run-in position for passing through the tubing string to a set position for positioning the whipstock face for engagement with the tool; and activating a wedge assembly at an upper end of the whipstock body for moving from a run-in position for passing the whipstock assembly through the tubing string to a set position for positioning the whipstock face for engagement with the tool, the wedge assembly being activated to move to the set position by radially moving at least one wedge member with respect to the whipstock body to engage the casing string and thereby radially space the upper end of the whipstock body from an interior surface of the casing string and position the whipstock face within the casing string for engaging the tool.

24. The method as defined in claim 23, further comprising:

providing upper wedge member radially moveable with respect to the whipstock body from the radially inward run-in position to a radially outward set position for engagement with the casing string; and providing a lower wedge member radially moveable with respect to both the upper wedge member and the whipstock body from the run-in position to the set position wherein the lower wedge member is sandwiched between the upper wedge member and the whipstock body when the wedge assembly is in the set position.

25. The method as defined in claim 24, further comprising:

slidably interconnecting a lower face of the upper wedge member with the upper face of the lower wedge member for moving the upper wedge member with respect to the lower wedge member from the run-in position to the set position; and slidably interconnecting a lower face of the lower wedge member and an upper face of the whipstock body for slidably moving the lower wedge member from the run-in position to the set position.

26. The method as defined in claim 24, further comprising:

providing a locking member for securing the position of the upper wedge member with respect to the lower wedge member when the wedge assembly is in the set position.

27. The method as defined in claim 26, further comprising:

releasing the locking member when the upper wedge member is in the set position; and thereafter retrieving the whipstock assembly through the tubing string.

28. The method as defined in claim 23, further comprising:

providing an elongate bore extending through the at least one wedge member and at least an upper portion of the whipstock body;

positioning a rod within the elongate bore for retaining the wedge assembly in the run-in position; and moving the rod with respect to the whipstock body to release the wedge assembly to the set position.

29. The method as defined in claim 28, further comprising:

supporting a whipstock setting tool at the lower end of coiled tubing workstring;

structurally interconnecting the whipstock setting tool and the rod; and moving the coiled tubing workstring upward with respect to the casing string to move the rod upward with respect to the whipstock body to release the wedge assembly to the set position.

30. The method as defined in claim 28, further comprising:

providing an elongate passageway from an upper portion of the whipstock body to a lower end of the whipstock body;

positioning a rod extension within the elongate passageway such that a lower end of the rod extension retains the hinge assembly in the run-in position; and moving the rod extension with respect to the whipstock body to release the hinge assembly to the set position.

31. The method as defined in claim 30, further comprising:

biasing the rod extension for releasing the hinge assembly to the set position;

engaging the rod extension with the rod to prevent movement of the rod extension with respect to the whipstock body while the wedge assembly is in the run-in position; and moving the rod out of engagement with the rod extension and thereby allowing the biased rod extension to move the hinge assembly to the set position.

32. The method as defined in claim 23, further comprising:

the tool is a rotatable mill for cutting a window in the casing string; and securing a lug on the whipstock body for engagement with the mill to commence cutting the window in the casing string.

33. The method as defined in claim 32, further comprising:

positioning the wedge assembly in the set position such that the lug is spaced within the casing string for wedging a nose piece independently rotatable with respect to cutters on the mill between the lug and an interior surface of the casing string circumferentially aligned with the location where the window is to be cut; and wedging the independently rotatable nose piece between the lug and the casing string to prohibit further downward movement of the mill with respect to the whipstock body, thereby reducing torque on the mill; and detecting the reduced torque on the mill to determine that the nose piece has been wedged between the lug and the casing string.

34. The thru tubing whipstock assembly for setting within a casing string on an anchor for securing the set whipstock assembly within the casing string after passing through a lower end of a tubing string positioned within the casing string, the whipstock assembly being settable within the casing string to divert a tool with respect to the casing string, the whipstock assembly comprising:

an elongate whipstock body having a whipstock face for diverting the tool;

a hinge assembly positioned between the whipstock body and the anchor for pivoting from a run-in position for passing the whipstock assembly through the tubing string to a set position for positioning the whipstock face for engagement with the tool; and a wedge assembly at an upper end of the whipstock body for moving from a run-in position for passing the whipstock assembly through the tubing string to a set position for positioning the whipstock face for engagement with the tool, the wedge assembly including at least one wedge member supported on and radially moveable with respect to the whipstock body from a radially inward run-in position to a radially outward set position for engagement with the casing string, the at least one wedge member including a connector for interconnection with a whipstock retrieval tool for retrieval of the whipstock assembly.

35. The whipstock assembly as defined in claim 34, wherein the wedge assembly comprises:

an upper wedge member radially moveable with respect to the whipstock body from the run-in position to the set position; and a lower wedge member radially moveable with respect to the whipstock body from the run-in position to the set position, the lower wedge member being sandwiched between the upper wedge member and the whipstock body when the wedge assembly is set within the casing string.

36. The whipstock assembly as defined in claim 35, further comprising:

a first dovetail interconnection between a lower face of the upper wedge member and an upper face of the lower wedge member for slidably interconnecting the upper wedge member and the lower wedge member; and a second dovetail interconnection between a lower face of the lower wedge member and an upper face of the whipstock body for slidably interconnecting the lower wedge member to the whipstock body.

37. The whipstock assembly as defined in claim 34, further comprising:

an elongate bore passing through the at least one wedge member and at least a portion of the whipstock body; and a rod for fitting within the elongate bore to prevent radial movement of the at least one wedge member with respect to the whipstock body when the wedge assembly is in the run-in position.

38. The whipstock assembly as defined in claim 34, wherein the wedge assembly comprises:

a plurality of wedge members each radially moveable with respect to the whipstock body from the run-in position to the set position;

a lower one of the plurality of wedge members being sandwiched between an adjoining upper one of the plurality of wedge members and the whipstock body when the wedge assembly is set within the casing string;

one or more interconnections each between a lower face of an upper one of the plurality of wedge members and an upper face of the lower one of the plurality of wedge members for slidably interconnecting the upper one of the plurality of wedge members and the lower one of the plurality of wedge members; and a lower one of the plurality of interconnections between a lower face of the lower one of the plurality of wedge members and an upper face of the whipstock body for slidably interconnecting the lower one of the plurality of wedge members to the whipstock body.

39. The whipstock assembly as defined in claim 34, wherein the hinge assembly includes a hinge arm rotatably connected to the anchor and rotatably connected to a lower end of the whipstock body, the hinge arm including an exterior surface for engagement with the interior surface of the casing string when the hinge assembly is in the set position.

40. A method of setting a thru tubing whipstock assembly within a casing string after passing the whipstock assembly through a lower end of a tubing string positioned within the casing string, the whipstock assembly being moveable to a set position within the casing string to divert a tool with respect to the casing string, the method comprising:

setting a whipstock anchor to secure the whipstock assembly within the casing string with an elongate whipstock body above the anchor for diverting the tool;

activating a hinge assembly positioned between the whipstock body and the anchor for pivoting the whipstock body from a run-in position for passing through the tubing string to a set position for positioning the whipstock face for engagement with the tool;

activating a wedge assembly at an upper end of the whipstock body for moving from a run-in position for passing the whipstock assembly through the tubing string to a set position for positioning the whipstock face for engagement with the tool, the wedge assembly being activated to move to the set position by radially moving at least one wedge member with respect to the whipstock body to engage the casing string and thereby position the whipstock face within the casing string for engaging the tool;

interconnecting a whipstock retrieval tool and the wedge assembly; and thereafter retrieving the whipstock assembly through the tubing string.

41. The method as defined in claim 40, further comprising:

providing upper wedge member radially moveable with respect to the whipstock body from the radially inward run-in position to a radially outward set position for engagement with the casing string; and providing a lower wedge member radially moveable with respect to both the upper wedge member and the whipstock body from the run-in position to the set position wherein the lower wedge member is sandwiched between the upper wedge member and the whipstock body when the wedge assembly is in the set position.

42. The method as defined in claim 41, further comprising:

slidably interconnecting a lower face of the upper wedge member with the upper face of the lower wedge member for moving the upper wedge member with respect to the lower wedge member from the run-in position to the set position; and slidably interconnecting a lower face of the lower wedge member and an upper face of the whipstock body for slidably moving the lower wedge member from the run-in position to the set position.

43. The method as defined in claim 40, further comprising:

providing a locking member for securing the position of the upper wedge member with respect to the lower wedge member when the wedge assembly is in the set position;

releasing the locking member when the upper wedge member is in the set position; and thereafter retrieving the whipstock assembly through the tubing string.

* * * * *